US007338877B1

(12) United States Patent
Meyer et al.

(10) Patent No.: US 7,338,877 B1
(45) Date of Patent: Mar. 4, 2008

(54) MULTICOMPONENT FIBER INCLUDING A LUMINESCENT COLORANT

(75) Inventors: August Karl Meyer, Jonesborough, TN (US); Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 319 days.

(21) Appl. No.: 10/722,380

(22) Filed: Nov. 25, 2003

Related U.S. Application Data

(60) Provisional application No. 60/429,636, filed on Nov. 27, 2002.

(51) Int. Cl.
*D02G 3/00* (2006.01)

(52) U.S. Cl. ..... 438/372; 428/373; 428/374

(58) Field of Classification Search ..... 428/373, 428/372, 374
See application file for complete search history.

(56) References Cited

U.S. PATENT DOCUMENTS

| | | | | |
|---|---|---|---|---|
| 2,382,355 | A | 8/1945 | Warren, Jr. | |
| 2,787,558 | A | 4/1957 | Wadely | |
| 3,608,298 | A | 9/1971 | Schoots | |
| 4,546,042 | A | 10/1985 | Quon | |
| 4,623,579 | A | 11/1986 | Quon | |
| 5,321,069 | A | 6/1994 | Owens | |
| 5,424,006 | A | 6/1995 | Murayama et al. | |
| 5,478,628 | A | 12/1995 | Billingsley et al. | |
| 5,674,437 | A | 10/1997 | Geisel | |
| 5,686,022 | A | 11/1997 | Murayama et al. | |
| 5,695,853 | A | 12/1997 | Billingsley et al. | |
| 5,741,590 | A | 4/1998 | Kobsa et al. | |
| 5,827,611 | A * | 10/1998 | Forbes | 428/375 |
| 6,162,539 | A * | 12/2000 | Shimizu et al. | 428/373 |
| 6,261,677 | B1 * | 7/2001 | Tsai et al. | 428/221 |
| 6,375,864 | B1 | 4/2002 | Phillips et al. | |
| 6,411,267 | B1 * | 6/2002 | Narui | 345/10 |
| 6,509,092 | B1 * | 1/2003 | Dugan | 428/374 |
| 6,815,060 | B2 * | 11/2004 | Yuuki | 428/364 |
| 6,855,422 | B2 * | 2/2005 | Magill et al. | 428/373 |
| 7,128,848 | B2 | 10/2006 | Pourdeyhimi et al. | |

FOREIGN PATENT DOCUMENTS

| | | | |
|---|---|---|---|
| JP | 04 034016 | A | 2/1992 |
| JP | 06 033318 | A | 2/1994 |
| JP | 06 128807 | A | 5/1994 |
| JP | 06 273227 | A | 9/1994 |
| JP | 09 269415 | A | 10/1997 |

* cited by examiner

*Primary Examiner*—N. Edwards
(74) *Attorney, Agent, or Firm*—Alston & Bird LLP

(57) ABSTRACT

The present invention is directed to multicomponent fibers having a non-luminescent first polymeric component and a second polymeric component comprising a luminescent colorant. The second component comprises less than about 50 percent of the total cross-section of the fiber. The fibers of the present invention may be incorporated into fabrics useful in the manufacture of safety apparel and equipment.

23 Claims, 1 Drawing Sheet

MULTICOMPONENT FIBER INCLUDING A LUMINESCENT COLORANT

CROSS REFERENCE TO RELATED APPLICATION

This application is related to commonly owned now abandoned Provisional Application Ser. No. 60/429,636, filed Nov. 27, 2002, incorporated herein by reference in its entirety, and claims the benefit of its earlier filing date under 35 U.S.C. 119(e).

FIELD OF THE INVENTION

The present invention relates to polymeric fibers and more particularly to multicomponent polymeric fibers with a component containing a luminescent colorant, as well as fabrics incorporating the fibers as a component thereof.

BACKGROUND OF THE INVENTION

Luminescent articles incorporating fluorescent or phosphorescent pigments can be found in a wide array of applications from safety apparel to ropes and tow. Fluorescent or phosphorescent pigments can be incorporated into such products by coating or laminating the product with a fluorescent or phosphorescent material. For example, U.S. Pat. No. 2,382,355 to Warren is directed to a rope that can be coated with a luminous material. U.S. Pat. No. 2,787,558 to Wadely is directed to a yarn product dipped or bathed in a solution of phosphorescent particles, binder and resin.

U.S. Pat. Nos. 4,623,579 and 4,546,042, each to Quon, are directed to decorative composite articles that include paired outer layers of a thermoplastic resin between which is disposed a decorative layer including a composition with a colorant component and a resin binder material. U.S. Pat. No. 3,608,298 to Schoots is directed to a laminated film product that includes outer clear plastic films laminated with an adhesive layer positioned therebetween and including a pearlescent material.

There can be problems associated with the manufacture and use of these and other coated or laminated products. The coating or laminate structure can exhibit poor adhesion so that the coating or layers of the composite can delaminate or otherwise detach. The coated or laminated product can also exhibit limited flexibility, which can create difficulties incorporating the same into a downstream product. The use of coatings or laminating techniques can also require numerous and time consuming processing steps. These and other issues can increase manufacturing costs and lengthen production times.

U.S. Pat. No. 5,741,590 to Kobsa et al. is directed to a satin weave filling faced fabric using sheath-core filaments. The Kobsa et al. patent states that an iridescent effect can be achieved by dyeing the core component and the sheath component different colors. Both the sheath and the core components of the fibers are dyed after fiber formation using different dye colors, thus requiring multiple processing steps and/or colorants to accommodate the different conditions required to apply different dye types to the fibers. See also JP 04034016, directed to a dyed conjugate fiber and JP 06128807, directed to a sheath/core fiber with a sheath/core ratio of 1:1 and colorant present in both the sheath and the core. See also JP 6033318, directed to a sheath/core fiber construction in which the core includes a polypropylene polymer blended with a fluorescent dye-containing nylon polymer.

U.S. Pat. No. 5,321,069 to Owens is directed to thermoplastic polymeric materials in pelletized or chip form treated so that the pellets or chips can be uniformly coated with a phosphorous pigment. The coated pellets or chips are formed into a melt and mixed to distribute the phosphorus material uniformly throughout the melt. The melt is extruded to form various textile products with phosphorus material distributed throughout the product. U.S. Pat. No. 5,674,437 to Geisel is directed to a method for providing luminescence to fibrous material in which a metal aluminate oxide pigment is combined with a thermoplastic polymer and the combination heated, mixed and extruded into a fiber in which the pigment is distributed throughout the cross section of the fiber.

SUMMARY OF THE INVENTION

The present invention provides multicomponent fibers exhibiting desirable light emission(s) with reduced colorant loading. The multicomponent fibers can thus provide economies of manufacture because less colorant can be required to achieve a desired brightness level for a particular application. In addition, the multicomponent fibers of the invention can be prepared without requiring expensive and/or time consuming processing aids, for example, without requiring dispersing aids, binders or other components that increase production time and costs.

The multicomponent fibers of the invention include at least one non-luminescent first polymeric component, e.g., a polymeric component that is substantially free of colorant. The fibers also include at least another polymeric component that includes one or more luminescent colorants.

In the invention, the cross sectional area of the luminescent colorant-containing component fibers is reduced. The multicomponent fibers are structured so that the polymeric component that includes the luminescent colorant is less than about 50 percent, or less than 35 percent, of the overall cross-sectional area of the multicomponent fiber. The luminescent colorant-containing component can beneficially include between about 10 percent and about 35 percent of the overall cross sectional area of the fiber.

As a result, the concentration of colorant in the colorant-containing component can be increased while maintaining the overall total colorant concentration within the fiber as a whole. While not wishing to be bound by any explanation of the invention, it is believed that the light emitted by adjacent particles excites particles nearby, compounding the brightness of emitted light. This effect is greater when the particles are in closer proximity to each other. By concentrating the colorant in a smaller area, an equivalent emission or brightness with lower colorant loadings can be provided, or alternatively, increased emission with equivalent colorant loading can be provided, as compared to prior art fibers that disperse the colorant throughout the entire cross-section of the fiber.

The multicomponent fibers can have various configurations, including, without limitation, sheath/core bicomponent fibers. In this aspect of the invention, the luminescent colorant can be present in either the core or the sheath component. Generally the luminescent colorant is present in the core component and the sheath component is free of luminescent colorant. In this aspect of the invention, the core can be centrically located within the fiber construct. Alternatively the core can be eccentrically located. Generally the sheath component makes up the entire outer exposed surface of the invention, although this is not required.

The multicomponent fibers of the invention can also be "islands in the sea" fibers, which include a "sea" component (or matrix polymer) surrounding a plurality of individual "island" components. Generally the sea component substantially surrounds and encapsulates the islands components. The sea component also generally makes up the entire outer exposed surface of the fibers, although, similar to the sheath/core fibers, this is not required. The luminescent colorant can be present in either the sea or one or more of the island components, and generally, the luminescent colorant is present in one or more island components.

The multicomponent fibers of the invention can have other configurations as well, such as but not limited to side-by-side fibers, lobed fibers, and the like, so long as the fibers include a component with luminescent colorant making up less than 50 percent by weight of the overall fiber cross section.

The luminescent colorant(s) can be any of the types of luminescent colorants known in the art, including without limitation fluorescent colorants, phosphorescent colorants, and mixtures thereof. Generally the luminescent colorant can be a luminescent pigment. Further, generally the luminescent colorant can exhibit photoluminescent properties, e.g., is a photoluminescent colorant, although the colorant can also emit light via other mechanisms, such as exhibited by chemiluminescent colorants, bioluminescent colorants, electroluminescent colorants, triboluminescent colorants, and the like.

The polymeric components of the multicomponent fibers of the invention can be selected from any of the types of material known in the art for fiber formation. Such materials include polymers useful for melt spinning as well as solution spinning. Exemplary polymers useful in the production of the multicomponent fibers of the invention include without limitation polyolefins, polyesters, polyamides, polyacrylates, polystyrenes, polyurethanes, acetal resins, polyethylene vinyl alcohol, thermoplastic elastomers, polyacrylonitriles, polyaramids, cellulose and cellulose derivatives and blends, copolymers and terpolymers thereof. Particularly useful polymers include, for example, aromatic polyesters such as polyethylene terephthalate, aliphatic polyesters, such as polylactic acid, polyamides, such as nylon 6 and nylon 6,6. and polyolefins, such as polypropylene.

The polymeric components of the multicomponent fibers of the invention can be formed of the same or different polymers. Generally, both the non-luminescent polymeric component and the polymeric component including a luminescent colorant are formed of the same polymer.

The amount of luminescent colorant present within the colorant containing polymeric component can vary, depending upon the particular use of the product. Generally, the luminescent colorant can be present in an amount ranging from about 0.01 percent by weight to about 20 percent by weight based on the total weight of the fiber. For example, a fiber of the invention can include a phosphorescent colorant in an amount ranging from about 1 to about 15, or from about 5 to about 15, percent by weight, based on the total weight of the fiber. As another example, a fiber of the invention can include a fluorescent colorant in an amount ranging from about 0.05 to 2.5, or from about 0.1 to about 2.5, percent by weight, based on the total weight of the fiber.

The present invention also provides articles including the multicomponent fibers as a component thereof. For example, the fibers can be formed into any of a variety of fabrics, including nonwoven, woven, and knit fabrics. The fibers can also be formed into yarn, tow, thread, or other products in which the luminescent property of the fibers would be beneficial. Such products can be further incorporated into a wide variety of downstream products, including safety apparel, novelty clothing, marine equipment, and the like.

BRIEF DESCRIPTION OF THE DRAWINGS

Figure 1:
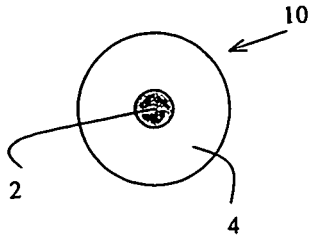
Figure 2:
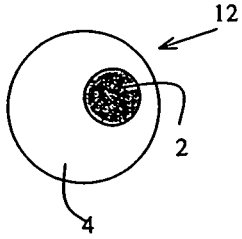
Figure 3:
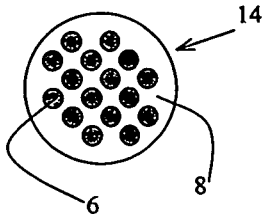
Figure 4:
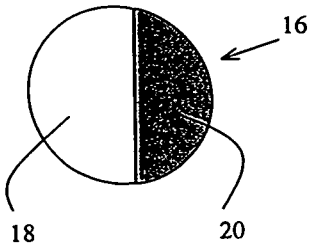
Figure 5:
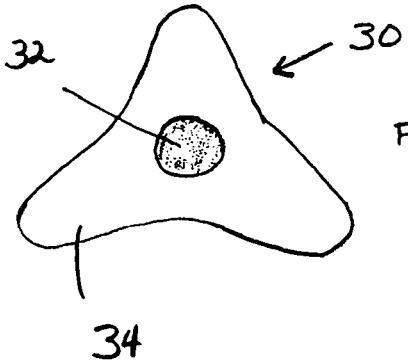

Having thus described the invention in general terms, reference will now be made to the accompanying drawings, which are not necessarily drawn to scale, and wherein:

FIG. 1 is a transverse cross sectional view of an exemplary sheath/core multicomponent fiber of the invention;

FIG. 2 is a transverse cross sectional view of a second exemplary sheath/core multicomponent fiber of the invention;

FIG. 3 is a transverse cross sectional view of an exemplary "islands in the sea" multicomponent fiber of the invention;

FIG. 4 is a transverse cross sectional view of an exemplary side-by-side multicomponent fiber of the invention; and FIG. 5 is a transverse cross sectional view of an exemplary multi-lobal multicomponent fiber of the invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As used in the specification, and in the appended claims, the singular forms "a", "an", "the", include plural referents unless the context clearly dictates otherwise.

The term "fiber" as used herein means both fibers of finite length, such as conventional staple fiber, as well as substantially continuous structures, such as continuous filaments, unless otherwise indicated. The fibers of the invention can be hollow or non-hollow fibers, and further can have a substantially round or circular cross section or non-circular cross sections (for example, oval, rectangular, multi-lobed, and the like).

As used herein, the term "multicomponent fibers" includes staple and continuous filaments prepared from two or more polymers present in discrete structured domains in the fiber, as opposed to blends where the domains tend to be dispersed, random or unstructured. For purposes of illustration only, the present invention will generally be described in terms of a bicomponent fiber comprising two components. However, it should be understood that the scope of the present invention is meant to include fibers with two or more structured components.

The term "dyeing" as used herein is intended to include the incorporation of dyes or pigments prior to or following extrusion. The distinctions between dyes and pigments and the processes for incorporating either are discussed in length in Aspland, J. R., *Textile Dyeing and Coloration*, American Association of Textile Chemists and Colorists, Research Triangle Park, N.C. (1997). Advantageously, the dyeing step occurs prior to extrusion.

The present invention provides a multicomponent fiber comprising at least two components, a first non-luminescent polymeric component and a second luminescent polymeric component comprising at least one luminescent colorant. The second polymeric component comprises less than about 50 percent of the cross-sectional area of the multicomponent fiber, thus concentrating the luminescent colorant in a relatively small section of the fiber. As explained in greater detail below, the present invention is based on the discovery that concentration of the colorant increases light emission without requiring higher colorant loading. So long as the luminescent polymeric component comprises less than 50% of the cross-sectional area of the fiber, the exact structural relationship between the two components is not critical to the invention. Several exemplary fiber configurations are described below with reference to the accompanying drawings.

FIG. 1 is a cross-sectional view of an exemplary multicomponent fiber of the present invention, designated generally as 10. Multicomponent fiber 10 is a sheath/core fiber that includes at least two structured polymeric components, an inner luminescent component 2 comprising a polymeric component and at least one luminescent colorant, and an outer non-luminescent component 4 comprising a non-luminescent polymeric component.

As used herein, the term "non-luminescent" refers to a polymeric component that is substantially free of luminescent colorant, preferably completely free of luminescent colorant, meaning no luminescent dye or pigment has been added to the polymeric component. FIG. 1 illustrates one advantageous embodiment of the invention, namely, a bicomponent fiber having an inner core polymer domain 2 and an outer surrounding sheath polymer domain 4. Core 4 can be concentric, as illustrated in FIG. 1. Alternatively, the core can be eccentric, as shown in FIG. 2, which illustrates an eccentric sheath/core fiber 12. The eccentric sheath/core fiber 12 is substantially the same as the embodiment of FIG. 1, except the core polymer domain 2 containing the luminescent colorant is eccentrically located within the outer polymer domain 4.

A concentric configuration is characterized by the sheath component having a substantially uniform thickness so that the core component lies approximately in the center of the fiber, such as illustrated in FIG. 1. This is in contrast to an eccentric configuration, such as illustrated in FIG. 2, in which the thickness of the sheath component varies, and the core component therefore does not lie in the center of the fiber. Concentric sheath/core fibers can be defined as fibers in which the center of the core component is biased by no more than about 0 to about 20 percent, preferably no more than about 0 to about 10 percent, based on the diameter of the sheath/core bicomponent fiber, from the center of the sheath component.

Other structured fiber configurations as known in the art can also be used. For example, FIG. 3 illustrates another advantageous embodiment of the invention in which the multicomponent fiber 14 of the invention is a "matrix" or "islands in a sea" type fiber having a plurality of inner, or "island," polymer components 6 surrounded by an outer matrix, or "sea," polymer component 8. Advantageously, island polymer component 6 advantageously contains the luminescent colorant and sea polymer component 8 is non-luminescent. The island components can be substantially uniformly arranged within the matrix of sea component 8, such as illustrated in FIG. 3. Alternatively, the island components can be randomly distributed within the sea matrix. The islands in the sea fiber can optionally also include a core, which can be concentric as illustrated or eccentric as described below. When present, the core is formed of any suitable fiber-forming polymer.

FIG. 4 illustrates yet another embodiment of the invention; namely, a side-by-side bicomponent fiber 16 wherein the non-luminescent component 18 and the luminescent colorant-containing component 20 are arranged in a side-by-side relationship.

The fibers of the invention can also include multilobal fibers having three or more arms or lobes extending outwardly from a central portion thereof. FIG. 5 is a cross sectional view of an exemplary multilobal fiber 30 of the invention. Fiber 30 includes a central core 32 and arms or lobes 34 extending outwardly therefrom. As illustrated, the arms or lobes 34 include non-luminescent polymer and central core 32 includes polymer and at least one luminescent colorant. Although illustrated in FIG. 5 as a centrally located core, the core can be eccentric.

Both the shape of the fiber and the configuration of the components therein will depend upon the equipment that is used in the preparation of the fiber, the process conditions, and the melt viscosities of the various components. A wide variety of fiber configurations are possible in the present invention. Generally, as illustrated in the figures, the fiber of the invention is a bicomponent fiber having first and second polymeric components. However, it should be understood that the scope of the present invention is meant to also include fibers with more than two components. Although the invention is not limited to two components, the terms first component and second component will be used throughout for the ease of describing the invention.

The terms "inner component" and "outer component" are used to generally describe the components of the fiber of the present invention when referring to sheath and core fibers, or matrix type fibers. The term outer component is intended to represent the component that forms a substantial portion of the exposed outer surface of the fiber, advantageously the entire exposed outer surface of the fiber. The term inner component is intended to reference the component contained substantially within the outer component with substantially no exposure to the outer surface of the fiber. These terms are used for the ease of describing the invention and are not intended to limit the invention to those fiber constructs.

The polymeric component forming the first and second components can be selected from any of the types of polymers known in the art that are capable of being formed into fibers, including polyolefins, polyesters, polyamides and the like. Examples of suitable polymers useful in the practice of the present invention include, without limitation, polyolefins including polypropylene, polyethylene, polybutene, and polymethyl pentene (PMP), polyamides including nylon, such as nylon 6 and nylon 6,6, polyacrylates, polystyrenes, polyurethanes, acetal resins, polyethylene vinyl alcohol, polyesters including aromatic polyesters, such as polyethylene terephthalate, polyethylene naphthalate, polytrimethylene terephthalate, poly(1,4-cyclohexylene dimethylene terephthalate) (PCT), and aliphatic polyesters such as polylactic acid (PLA), polyphenylene sulfide, thermoplastic elastomers, polyacrylonitrile, cellulose and cellulose derivatives, polyaramids, acetals, fluoropolymers, copolymers and terpolymers thereof and mixtures or blends thereof.

Further examples of aliphatic polyesters which may be useful in the present invention include, without limitation, fiber forming polymers formed from (1) a combination of an aliphatic glycol (e.g., ethylene, glycol, propylene glycol, butylene glycol, hexanediol, octanediol or decanediol) or an oligomer of ethylene glycol (e.g., diethylene glycol or triethylene glycol) with an aliphatic dicarboxylic acid (e.g., succinic acid, adipic acid, hexanedicarboxylic acid or decaneolicarboxylic acid) or (2) the self condensation of hydroxy carboxylic acids other than poly(lactic acid), such as polyhydroxy butyrate, polyethylene adipate, polybutylene adipate, polyhexane adipate, and copolymers containing them.

Aromatic polyesters include (1) polyesters of alkylene glycols having 2-10 carbon atoms and aromatic diacids; (2) polyalkylene naphthalates, which are polyesters of 2,6-naphthalenedicarboxylic acid and alkylene glycols, as for example polyethylene naphthalate; and (3) polyesters derived from 1,4-cyclohexanedimethanol and terephthalic acid, as for example polycyclohexane terephthalate. Exemplary polyalkylene terephthalates include without limitation, polyethylene terephthalate (also PET) and polybutylene terephthalate.

Exemplary fibers of the invention include fibers in which the luminescent component is formed of a polyolefin such as polypropylene, an aromatic or aliphatic polyester such as polyethylene terephthalate or polylactic acid, or a polyamide such as nylon 6 or nylon 6,6. Although not required, the non-luminescent component of the fibers of the present invention can advantageously be formed of the same polymer as the luminescent component.

Each of the polymeric components of the multicomponent fibers of the invention can optionally include other components not adversely affecting the desired properties thereof. Exemplary materials that could be used as additional components include, without limitation, antioxidants, stabilizers, surfactants, waxes, flow promoters, solid solvents, particulates, and other materials added to enhance processability or end-use properties of the polymeric components. Such additives can be used in conventional amounts.

The luminescent colorant can be any luminescent colorant known in the art. Exemplary luminescent colorants useful in the present invention include fluorescent colorants, phosphorescent colorants, and mixtures thereof. As used herein the term "luminescence" refers to the emission of light by a substance for any reason other than heat, or a rise in temperature. It occurs as a result of the emission of photons by an atom when it returns to its ground state from an excited state. If the luminescence stops as soon as the exciting source is removed, it is typically known as fluorescence. If the luminescence continues, typically longer than $10^{-8}$ seconds, it is normally called phosphorescence.

Numerous types of phosphorescence and fluorescence are known. For example, if the excited state is caused by a photon, the process is photoluminescence. Photoluminescent colorants can be advantageous in various applications. If an electron causes the excited state, the process is electroluminescence.

Other types of luminescence are known including without limitation chemiluminescence (i.e., luminescence resulting form a chemical reaction); bioluminescence (i.e., luminescence resulting from a living organism typically mediated by enzymatic or other biological system); and triboluminescence (i.e., luminescence resulting from friction such as by crushing, rubbing or scratching a crystal). It is believed that other luminescent colorants may also be useful in the present invention, such as chemiluminescent colorants, bioluminescent colorants, electroluminescent colorants, triboluminescent colorants and combinations or mixtures thereof.

Conventional pigments produce color by selectively reflecting part of the incident light and absorbing the remainder, which is converted to heat. Photoluminescent colorants, such as photoluminescent pigments, are the basis for almost all glow-in-the-dark products. These pigments are typically non-toxic and non-radioactive. They are available in a wide variety of colors and performance. Photoluminescent colorants have a basic crystalline structure and a tremendous capacity of absorbing, storing and emitting light. The crystals absorb any ambient light, including regular indoor light. Each has unique properties and one of ordinary skill in the art would readily ascertain the appropriate photoluminescent colorant appropriate for each application.

Fluorescent colorants convert part of the absorbed energy into light of their own color, thus re-emitting more light than actually falls on them, thereby causing a glow called fluorescence. The most common examples of fluorescent colorants are those that glow different colors under black lights; that is, they absorb UV irradiation and emit visible light. Examples of fluorescent colorants suitable for use in the present invention include the DAY-GLO® series manufactured by Day-Glo Color Corporation. Also suitable for use in the present invention are fluorescent colorants, particularly dye-based additives for polyethylene terephthalate, available from Clariant Corporation, and fluorescent whiteners and optical brighteners such as OB-1 from Eastman Chemical Company. Further examples of fluorescent colorants suitable for use in the present invention include coumarin dyes, such as Macrolex Fluorescent Yellow 10GN, Fluorescent Yellow FP, and Fluorescent Red G (available from Bayer), Thermoplast Yellow 084 (available from BASF), HOSTASOL® Solvent Yellow 98, Solvent Orange 63 and Vat Red 41 (each available from Clariant Corporation), and LUMOGEN® Dyes manufactured by BASF. Other fluorescent colorants known in the art are also useful, and one skilled in the art can readily select the appropriate fluorescent colorant to incorporate into the present invention based on, for example, the desired color.

Phosphorescent colorants are available in numerous colors and particle sizes. They are particularly useful in safety clothing. Examples of phosphorescent colorants suitable for use in the present invention include sulfides of zinc, calcium, strontium and cadmium, or complex sulfides including zinc and cadmium sulfide. A particularly useful group of phosphorescent colorants are metal aluminate oxide pigments, such as LUMINOVA®, available from United Mineral and Chemical Corporation. For the purposes of this invention, the term "metal aluminate oxide pigment" refers to a luminescent pigment expressed by $M_{1-x}Al_2O_{4-x}$, preferably $MAl_2O_4$, in which M is at least one metal element selected from the group consisting calcium, strontium, and barium, and which further contains one activator and an additional co-activator doped therein. Alternatively, the metal aluminate oxide pigment is expressed by $MAl_2O_4$, in which M is plural metal elements, which are composed of magnesium and at least one metal element selected from the group consisting of calcium, strontium and barium, and which further contains an activator and a co-activator doped therein. The first activator can be europium, and the co-activator may be an element selected from the group consisting of lanthanum, cerium, praseodymium, neodymium, samarium, gadolinium, dysprosium, holmium, erbium, thulium, ytterbium, lutetium, tin and bismuth. Such metal aluminate oxide pigments are described in U.S. Pat. Nos. 5,424,006, 5,674,437 and 5,686,022, the disclosures of which are herein incorporated by reference. Advantageous phosphorescent colorants include zinc sulfide, strontium sulfide and metal aluminate oxides. It would be understood by one of skill in the art that other phosphorescent colorants would be similarly useful in the present invention.

Advantageously, the luminescent colorant is a pigment and incorporated into the polymeric component prior to extrusion. As is known in the art, many dye-based colorants are processed like pigments and can also be used in the present invention.

The luminescent colorant is present in an amount of from about 0.01 to about 20 percent by weight based on the total fiber weight. In the case of fluorescent colorants including various dyes, whiteners and optical brighteners, the luminescent colorant can be present in an amount of from about 0.01 percent by weight to about 5 percent by weight of the total fiber, advantageously about 0.05 to about 2.5 percent by weight and more advantageously about 0.1 to about 1 percent by weight. In the case of phosphorescent colorants, the luminescent colorant can be present in an amount of from about 0.1 percent by weight to about 20 percent by weight of the total fiber, advantageously about 1 percent to about 15 percent by weight, and more advantageously about 5 percent to about 15 percent by weight.

The luminescent colorant-containing component of the multicomponent fiber of the invention comprises less than about 50 percent of the total cross-sectional area of the fiber. Advantageously, the luminescent colorant-containing component comprises less than about 35 percent of the total cross-sectional area of the fiber and can beneficially comprise between about 10 percent and about 35 percent. In some embodiments of the invention, the luminescent colorant-containing component of the fiber comprises about 45%, about 40%, about 35%, about 30%, about 25%, about 20%, about 15% or about 10% of the total cross-sectional area of the fiber. Yet despite the reduced percentage of luminescent colorant containing component, the fibers of the invention can exhibit light emission the same as or even greater than fibers with the same colorant at higher loadings.

The present invention is based, in part, on the discovery that re-emitted light from a luminescent colorant is higher per gram of colorant when the proximity of the individual colorant particles is higher. This discovery has been exploited in the present invention by reducing the cross-sectional area of the luminescent colorant-containing component of the multicomponent fiber, thereby increasing the concentration of the colorant in the colorant-containing fiber component while maintaining the same the total colorant concentration within the fiber. While not wishing to be bound by any particular theory, it is believed that the light emitted by adjacent particles excites particles nearby, compounding the brightness of emitted light. This effect is greater when the particles are in closer proximity to each other. By concentrating the colorant in a smaller area, an equivalent emission or brightness with lower colorant loadings is provided, or alternatively, increased emission with equivalent colorant loading is provided, as compared to prior art fibers that disperse the colorant throughout the entire cross-section of the fiber.

The fibers of the present invention may be made from any of the known fiber forming methods including, but not limited to solution spinning for making fibers including rayon and Kevlar®, or melt spinning. These and other methods for making multicomponent fibers are well known and will not be discussed in great detail.

Generally, for melt-spinning multicomponent fibers, at least two polymers are extruded separately and fed into a polymer distribution system wherein the polymers are introduced into a spinneret plate. In the present invention, the luminescent colorant and at least one of the polymers can be mixed or blended prior to extrusion using known techniques. The colorant can accordingly be distributed or dispersed substantially uniformly throughout at least one of the polymer streams fed into the spinneret plate. The polymers follow separate paths to the fiber spinneret and are combined in a spinneret hole. The spinneret is configured so that the extrudant has the desired overall fiber cross-section (e.g., round, oval, etc.).

Following extrusion through the die, the resulting thin fluid strands, or filaments, remain in the molten state for some distance before they are solidified by cooling in a surrounding fluid medium, which may be, for example, chilled air blown through the strands. Once solidified, the filaments are taken up on a godet or another take-up surface. In a continuous filament process, the strands can be taken up on a godet which draws down the thin fluid streams in proportion to the speed of the take-up godet. In a spunbond process, the strands can be collected in a jet, such as for example, an air attenuator, and blown onto a take-up surface such as a roller or a moving belt to form a spunbond web. In a meltblown process, air is ejected at the surface of the spinneret which serves to simultaneously draw down and cool the thin fluid streams as they are deposited on a take-up surface in the path of cooling air, thereby forming a fiber web.

Regardless of the type of melt spinning procedure which is used, generally the thin fluid streams are melt drawn down in a molten state, i.e., before solidification occurs, to orient the polymer molecules for good tenacity. Typical melt draw down ratios known in the art may be utilized. The skilled artisan will appreciate that specific melt draw down is not required for meltblowing processes. Where a continuous filament or staple process is employed, it may be desirable to draw the strands in the solid state with conventional drawing equipment, such as, for example, sequential godets operating at differential speeds.

Following drawing in the solid state, the continuous filaments may be mechanically crimped and cut into a desirable fiber length, thereby producing staple fiber. The length of the staple fibers generally ranges from about 25 to about 50 millimeters, although the fibers can be longer or shorter as desired.

The multicomponent fibers of the invention can be staple fibers, continuous filaments, or meltblown fibers. In general, staple fibers, multifilament, and spunbond fibers formed in accordance with the present invention can have a fineness of about 0.5 to about 100 denier per filament. Meltblown filaments can have a fineness of about 0.001 to about 10.0 denier. Monofilament fibers can have a fineness of about 50 to about 10,000 denier.

The multicomponent fibers of the invention are useful in the production of a wide variety of products, including without limitation nonwoven structures, such as but not limited to carded webs, wet laid webs, dry laid webs, spunbonded webs, meltblown webs, and the like. The nonwoven webs can be bonded to transform the webs into a coherent nonwoven fabric using bonding technique as known in the art. Exemplary bonding techniques for nonwoven webs include mechanical bonding, such as hydroentanglement and needle punching, adhesive bonding, thermal bonding, and the like. An example of thermal bonding is through air bonding, although other thermal bonding techniques, such as calendering, microwave or other RF treatments, can be used.

Fibers other than the multicomponent fibers of the invention may be present as well, including any of the various synthetic and/or natural fibers known in the art. Exemplary synthetic fibers include polyolefin, polyester, polyamide, acrylic, rayon, cellulose acetate, polyaramids, thermoplastic multicomponent fibers (such as conventional sheath/core fibers, for example polyethylene sheath/polyester core fibers) and the like and mixtures thereof. Exemplary natural fibers include wool, cotton, wood pulp fibers and the like and mixtures thereof.

The fibers of the invention can also be used to make other textile structures such as, but not limited to, woven and knit fabrics. Yarns prepared for use in forming such woven and knit fabrics are similarly included within the scope of the present invention. Such yarns may be prepared from the continuous filament or spun yarns comprising staple fibers of the present invention by methods known in the art, such as twisting or air entanglement.

The multicomponent fibers of the invention as well as fabric, yarn, and other articles including the same as a component can be useful in a variety of applications. For example, the multicomponent fibers can be used in outdoor apparel and safety equipment such as safety apparel, ropes, tows, tapes, and any other application in which the use of luminescent colorants might be advantageous.

The following examples are given to illustrate the invention, but should not be considered in limitation of the invention.

EXAMPLE 1

As a comparative sample, a nylon filament yarn is spun using a uniform blend of phosphorescent pigments in nylon 6 polymer. The pigments comprise 6% of the weight of the blend of pigments in nylon. The yarn is spun with 70 filaments and fully drawn to a total yarn denier of 320. The pigment dispersion is essentially uniform throughout the entire cross section of every filament in the yarn.

A bicomponent nylon filament yarn of the invention is also spun with a sheath/core cross section. The sheath component comprises nylon 6 and contain no pigment. The core component comprises a uniform blend of the same phosphorescent pigments used in the comparative example above in nylon 6. In this blend, the phosphorescent pigment comprises 30% of the weight of the blend of pigment and nylon 6. The melt pumps for the sheath and core polymers are set to produce a ratio of 80%:20% of the cross sectional area of each fiber occupied by the pigment-free sheath and the pigmented core, respectively. The yarn is spun with 70 filaments and fully drawn to a total yarn denier of 320. Thus the total pigment loading in the fiber is still 6% of the weight of the entire fiber, but in this case the pigment is concentrated in an area only 20% as large as the area occupied by the same amount of pigment in the yarn of the comparative example.

Brightness Testing

A brightness test is conducted to compare the emission of light from the yarns of the comparative sample and the sample based upon the present invention. Under equivalent conditions of exposure to light followed by comparison of the yarns of the inventive example with the yarns of the comparative example in darkness, it is determined that the yarns of the inventive example glow with greater brightness than the yarns of the comparative example.

EXAMPLE 2

A first sample fiber is prepared to include 6% phosphorescent pigment, based on the weight of the fiber, but the pigment is all contained in a core comprising only 20 percent of the cross-sectional area of the fiber. A second fiber sample is prepared as a comparative and also includes 6% phosphorescent pigment. In the second fiber, the pigment is evenly dispersed throughout the entire cross section of the fiber. Both fibers are made with the same nylon 6 polymer using the same spinning and drawing conditions, and both have the same denier per filament.

Both samples are exposed to the same light source for the same period of time, and the emitted light is measured for each sample. After exposing both samples to the same light source for the same time, the first sample emits an average of 17% more light than the second sample, based on comparative measurements made at multiple points over a 100 minute period. The second comparative sample did not emit more light than the first sample of the invention for any of the measurements.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A sheath and core bicomponent fiber, comprising:

a sheath comprising a non-luminescent first polymeric component; and a core comprising a second polymeric component, the second polymer component comprising at least one phosphorescent colorant, wherein the colorant is present in an amount of about 0.1% by weight to about 9% by weight based on the total weight of the fiber;

wherein the core comprises less than about 20 percent of the cross-sectional area of the bicomponent fiber.

2. The bicomponent fiber of claim 1, wherein said first polymeric component and said second polymeric component are formed from the same polymer selected from the group consisting of nylon 6, nylon 6,6, polyethylene terephthalate, polylactic acid, and polypropylene.

3. A fabric comprising a plurality of bicomponent fibers according to claim 1.

4. The fabric of claim 3, wherein the fabric is selected from the group consisting of woven fabrics, knit fabrics, and nonwoven fabrics.

5. An outdoor apparel or safety equipment article comprising a plurality of bicomponent fibers according to claim 1.

6. The bicomponent fiber of claim 1, wherein the sheath is multilobal.

7. The bicomponent fiber of claim 1, wherein the core comprises less than about 15% of the cross-sectional area of the bicomponent fiber.

8. The bicomponent fiber of claim 1, wherein the core comprises about 10% to about 20% of the cross-sectional area of the bicomponent fiber.

9. The bicomponent fiber of claim 1, wherein said fiber is selected from the group consisting of continuous filaments, staple fibers, spunbond fibers, and meltblown fibers.

10. The bicomponent fiber of claim 1, wherein said first and second polymeric components are each independently selected from the group consisting of polyolefins, polyesters, polyamides, polyacrylates, polystyrenes, polyurethanes, acetal resins, polyethylene vinyl alcohol, thermoplastic elastomers, polyacrylonitrile, polyaramids, cellulose and cellulose derivatives, and blends and co- and terpolymers thereof.

11. The bicomponent fiber of claim 1, wherein said first polymeric component and said second polymeric component comprise the same polymer.

12. The bicomponent fiber of claim 11, wherein both of said first polymeric component and said second polymeric component comprises a polyamide polymer.

13. The bicomponent fiber of claim 12, wherein both of said first polymeric component and said second polymeric component comprises a polyamide polymer selected from the group consisting of nylon 6 and nylon 6,6.

14. The fiber of claim 11, wherein both of said first polymeric component and said second polymeric component comprises an aromatic polyester polymer.

15. The bicomponent fiber of claim 14, wherein both of said first polymeric component and said second polymeric component comprises polyethylene terephthalate.

16. The bicomponent fiber of claim 11, wherein both of said first polymeric component and said second polymeric component comprises an aliphatic polyester polymer.

17. The bicomponent fiber of claim 16, wherein both of said first polymeric component and said second polymeric component comprises polylactic acid.

18. The bicomponent fiber of claim 11, wherein both of said first polymeric component and said second polymeric component comprises a polyolefin polymer.

19. The bicomponent fiber of claim 18, wherein both of said first polymeric component and said second polymeric component comprises polypropylene.

20. The bicomponent fiber of claim 1, wherein the colorant is a phosphorescent colorant selected from the group consisting of metal aluminate oxide, sulfides of zinc, calcium, strontium and cadmium, and complex sulfides of zinc and cadmium sulfide.

21. The bicomponent fiber of claim 20, wherein said phosphorescent colorant is metal aluminate oxide, zinc sulfide or strontium sulfide.

22. The bicomponent fiber of claim 1, wherein the core is concentrically located within the sheath.

23. The bicomponent fiber of claim 1, wherein the core is eccentrically located within the sheath.

* * * * *